US005539928A

United States Patent [19]

Aldridge

[11] Patent Number: 5,539,928

[45] Date of Patent: Jul. 30, 1996

[54] FIREFIGHTER GARMENT WITH LOW FRICTION LINER SYSTEM

[75] Inventor: Donald Aldridge, New Carlisle, Ohio

[73] Assignee: Lion Apparel, Inc., Dayton, Ohio

[21] Appl. No.: 151,408

[22] Filed: Nov. 12, 1993

[51] Int. Cl.[6] ..... A41D 13/00

[52] U.S. Cl. ..... 2/93; 2/79; 2/81; 2/97

[58] Field of Search ..... 2/79, 81, 82, 85, 2/86, 87, 93, 97, 227, 69; 139/420 A, 420 R; 428/920

[56] References Cited

U.S. PATENT DOCUMENTS

| | | | |
|---|---|---|---|
| 4,179,752 | 12/1979 | Fackelmann . | |
| 4,494,247 | 1/1985 | Kelly . | |
| 4,843,646 | 7/1989 | Grilliot et al. . | |
| 4,945,571 | 8/1990 | Calvert . | |
| 5,014,354 | 5/1991 | Dument . | |
| 5,136,723 | 8/1992 | Aldridge et al. | 2/81 |
| 5,202,086 | 4/1993 | Baliga et al. | 139/420 A |
| 5,246,782 | 9/1993 | Kennedy et al. | 428/421 |
| 5,299,602 | 4/1994 | Barbeau et al. | 139/420 A |
| 5,323,815 | 6/1994 | Barbeau et al. | 2/81 |

OTHER PUBLICATIONS

Fabric GLOBE Product Catalog, Globe Manufacturing Co., 1980.

*Primary Examiner*—Diana Biefeld
*Attorney, Agent, or Firm*—Thompson Hine & Flory P.L.L.

[57] ABSTRACT

A firefighter garment having a low friction liner system which includes an outer shell made of an abrasion resistant material, a moisture barrier layer made of a water-resistant material, a thermal barrier layer and a layer of material having high-lubricity positioned within the outer shell. In one embodiment, the high-lubricity layer is composed of a fire resistant filament yarn and is attached to the inside face of the thermal liner; that is, the face positioned next to the clothing of a wearer of the garment. In another embodiment, the layer of high-lubricity material is positioned to form a substrate for the moisture barrier and is located between the moisture barrier and outer shell. A garment having two layers of high-lubricity material, one forming an inside face of the thermal liner and the other forming an interface between the moisture barrier and outer shell, is also preferable. Alternately, the high-lubricity material is in the form of patches positioned at areas of high movement and friction on the garment, such as the shoulders and elbows of a coat, and the knees of a pant. All of the aforementioned embodiments reduced the friction between the layers of the garment, and between the garment and the wearer, thereby reducing the amount of energy expended by wearer of the garment while moving. This reduction of energy reduces the amount of stress imposed by the garment on a wearer.

18 Claims, 2 Drawing Sheets

FIREFIGHTER GARMENT WITH LOW FRICTION LINER SYSTEM

BACKGROUND OF THE INVENTION

The present invention relates to garments worn for protection from a hazardous environment, and more particularly, to garments worn by firefighters for protection from extreme heat, moisture and abrasion.

With the implementation of modern, heat resistant aramid fibers, such as NOMEX and KEVLAR materials (both registered trademarks of E. I. DuPont de Nemours & Co., Inc.), and moisture barrier materials made of GORE-TEX (a registered trademark of W. L. Gore & Associates, Inc.), modern day firefighter garments provide to the wearer adequate resistance to heat, flame, abrasion and moisture. Further, advancement in helmet materials and S.C.B.A (Self-Contained Breathing Apparatus) systems provide adequate protection for a firefighter from head impacts and noxious gases.

As a result, injury to the firefighter resulting from stress imposed by the hostile firefighting environment is emerging as a common type of injury. Consequently, efforts are being made to reduce the amount of stress imposed on a firefighter.

One form of stress is imposed by the environment and comprises the high heat present in most firefighting situations. Such stress is unavoidable. Another type of stress arises from the protective garments worn by a firefighter. Most firefighter garments comprise an outer shell of an aramid material, a moisture barrier made of semi-permeable membrane of GORE-TEX, and a thermal liner of an aramid batting. Such a thermal liner typically includes a face cloth of a woven aramid in a plain weave. While a garment comprising such layers possesses adequate abrasion, thermal and moisture resistance, friction between the layers of such garments hinders the ability of a firefighter to move, and increases the amount of effort required to perform a specific task. Also, a large amount of frictional stress arises from the rubbing of the face cloth against the clothing of the wearer. Accordingly, there is in need to provide a firefighter garment in which the stress resulting from such interlayer friction is reduced.

SUMMARY OF THE INVENTION

The present invention is a firefighter garment with a low friction liner system in which the friction resulting from relative movement between adjacent layers, as well as from the face cloth rubbing against the garments of the wearer, is reduced. The firefighter garment of the preferred embodiment includes an outer shell of an abrasion-resistant aramid material, a moisture barrier layer and a thermal layer. In the preferred embodiment, the low friction liner system comprises a layer of a fire resistant, high-lubricity fabric, such as filament yarn, which is positioned between the moisture barrier and the outer shell. The presence of this layer of high-lubricity fabric reduces the friction created by the rubbing of the moisture barrier against the outer shell which results from movement by the wearer, and therefore reduces the amount of energy expended by a wearer of the garment while moving.

In another embodiment, the face cloth of the thermal liner throughout the garment is made of a high-lubricity, fire resistant fabric, such as filament yarn. It has been found that the highest level of friction imposed by a firefighter garment occurs between the thermal liner face cloth and the clothing of a wearer. By interposing a face cloth of a high-lubricity material between the thermal layer and the wearer, the amount of stress generated by this high friction interface is substantially reduced.

Accordingly, it is an object of the present invention to provide a firefighter garment with a low friction liner system which substantially reduces the amount of energy required of a wearer to move while wearing the garment, and thereby reduces the amount of stress imposed by the garment on a wearer; a firefighter garment with a low friction liner system which does not sacrifice the fire and heat resistance of the garment in order to reduce the amount of stress imposed by the garment on a wearer; a firefighter garment with a low friction liner system which is relatively inexpensive to implement and fabricate, and is relative easy to maintain and clean; and a firefighter garment with a low friction liner system which is not excessively costly to fabricate.

Other objects and advantages of the present invention will be apparent from the following description, the accompanying drawings and the appended claims.

DETAILED DESCRIPTION

Figure 1:
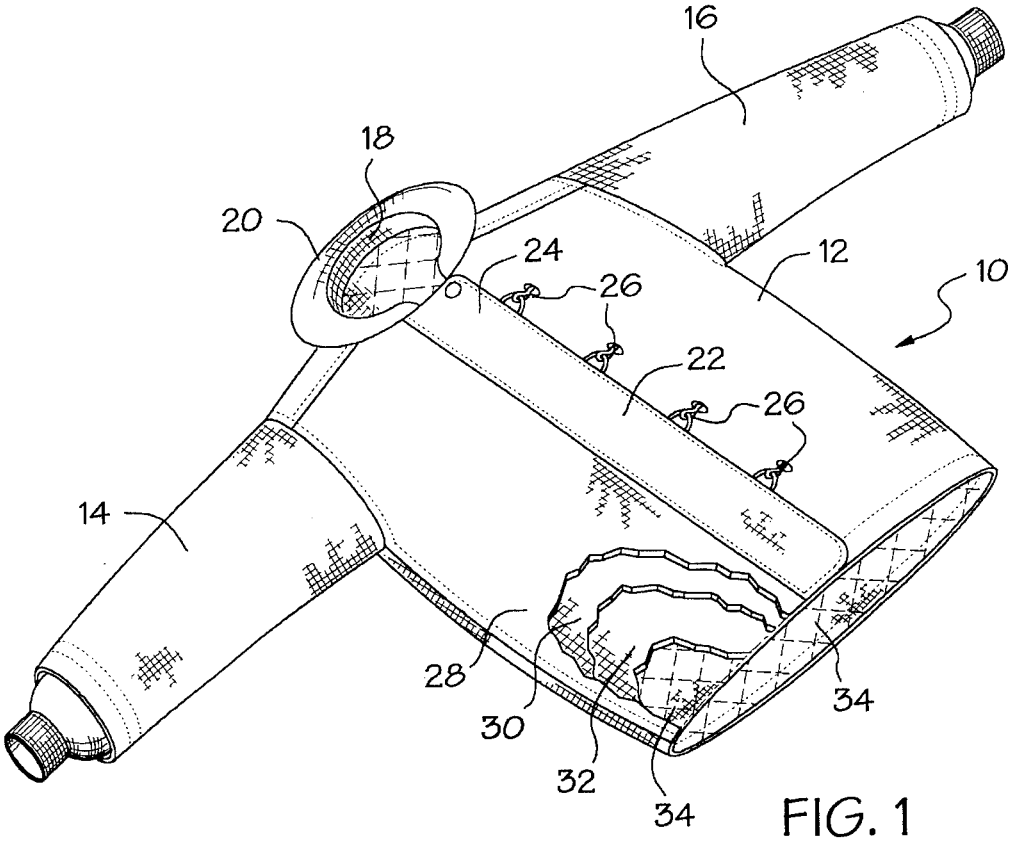
FIG. 1 is a somewhat schematic, perspective view of a firefighter garment or incorporating a liner system of a preferred embodiment of the invention.

As shown in FIG. 1, a firefighter garment of a present invention having a low friction liner system is generally designated 10 and includes a body portion 12, sleeves 14, 16, and neck opening 18, surrounded by a collar 20. It is to be understood that the garment could be in the form of another article of clothing, such as trousers (see FIG. 5), and not depart from the scope of the invention. The body portion 12 includes a front closure 22 having a slide fastener (not shown) and a flap 24 secured by "hook and D" devices 26.

Figure 2:
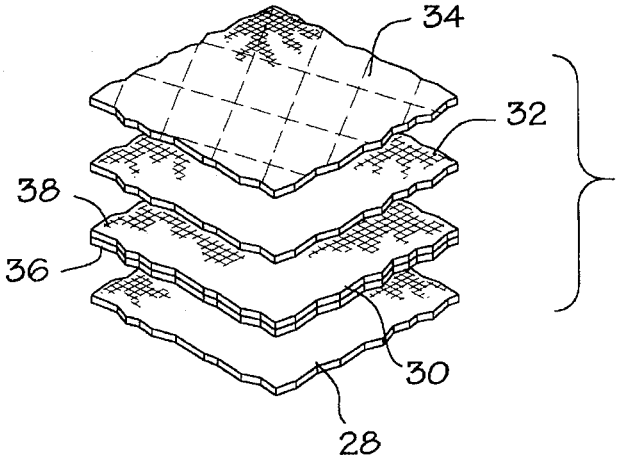
FIG. 2 is a detail showing an exploded view of the various layers of the garment of FIG. 1.

As shown in FIGS. 1 and 2, the garment 10 includes an outer shell 28 covering the entire garment and made of an aramid material such as NOMEX or KEVLAR, a moisture barrier layer 30, a thermal liner layer 32 and a face cloth layer 34. The moisture barrier layer 30 preferably includes a layer of GORE-TEX material on a substrate 38 of NOMEX material. The thermal liner layer 32 preferably is a batting of aramid fibers. The face cloth layer 34 preferably is a filament yarn quilted to the thermal liner layer 32 and is made of a fire resistant material, such as NOMEX material. Other acceptable materials for the layer 34 are a combination of filament and spun, and a permanently chemically altered spun yarn having the desired degree of lubricity. The face cloth layer 34 extends throughout the garment 10, including the body portion 12 and sleeves 14, 16. The face cloth layer 34 is a plain weave, in the preferred embodiment, for lightness, but a heavier twill weave may be used since it provides less contact surface per unit area than plain or broadcloth weaves.

As a result of the presence of the high-lubricity face cloth layer 34 throughout the garment 10, the frictional forces resulting from the abrasion of the clothing of the wearer against the face cloth are significantly reduced, thereby reducing the amount of energy expended by a wearer to move while wearing the garment. This reduction in energy required for movement reduces the stress imposed upon the wearer during a firefighting situation.

Figure 3:
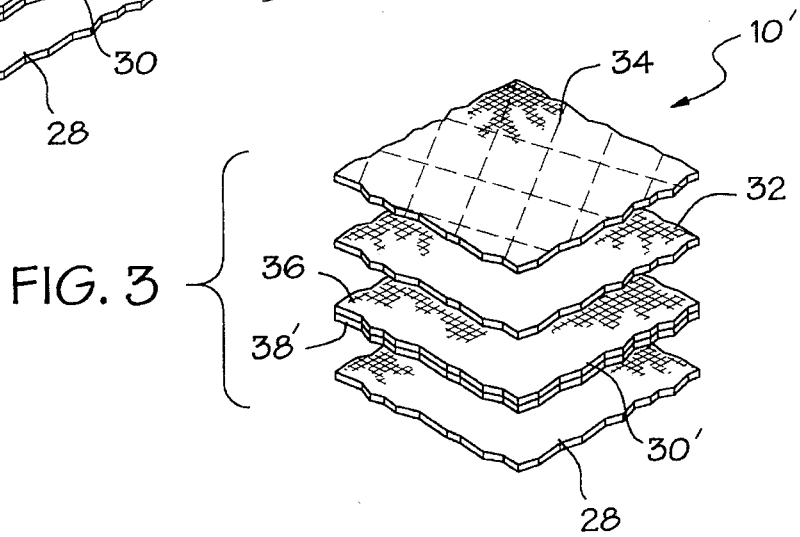
FIG. 3 is a detail, similar to that of FIG. 2, of an alternate embodiment of the invention.

An alternate embodiment of the invention 10' is shown in FIG. 3. With the embodiment 10', the low friction liner system includes an outer shell 28 of an aramid material, a moisture barrier layer 30', a thermal liner layer 32 and a face cloth layer 34 made of a high-lubricity filament yarn having fire resistant properties. Again, materials such as a combination of filament and spun or chemically altered spun yarn may be used. The moisture barrier layer 30' includes a substrate 38' which is positioned between the GORE-TEX layer 36 and the outer shell 28. The substrate 38' is bonded to the film membrane of the GORE-TEX layer 36 by a suitable adhesive. The substrate 38' is made of a high-lubricity filament yarn having fire resistant characteristics, such as an aramid fiber.

In preferred embodiment, the layers 38' and 34 extend substantially throughout the entire garment, so that frictional engagement of the outer shell and moisture barrier layers, as well as the frictional engagement between the thermal barrier and garment of the wearer, are substantially reduced. By inverting the moisture barrier 30' such that the GORE-TEX layer 36 faces thermal liner 32, a low friction interface exists between the moisture barrier and thermal liner. Consequently, with the arrangement of FIG. 3, a high-lubricity, low friction interface exists between each of the layers of the garment 10', as well as between the garment 10' and the wearer. Accordingly, with the embodiment of FIG. 3, the stress created by frictional engagement of the garment 10' with the clothing of the wearer, and internally within the garment, is minimized.

Figure 4:
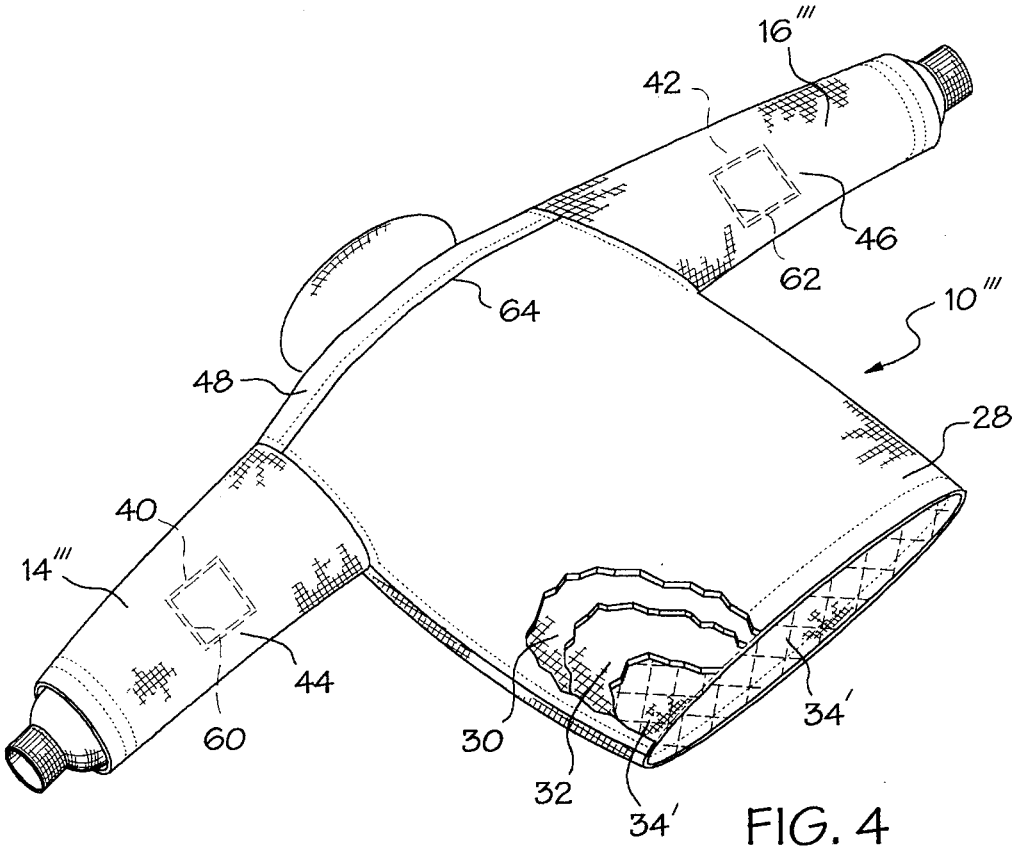
FIG. 4 is a somewhat schematic, perspective view of the reverse side of a firefighter turnout coat embodying the invention.

As shown in FIG. 4, in an alternate embodiment of the invention, the face cloth layer 34' is made of a conventional spun NOMEX material throughout the coat 10'''. Patches 40, 42 are attached by stitching on by a suitable adhesive to the face cloth layer 34' in the elbow regions 44, 46 of the sleeves 14''', 16''', and in the shoulder region 48. The patches 40, 42, 48 are each made of a spun NOMEX material having high-lubricity characteristics. This construction reduces friction in areas of relatively high movement of the wearer, so that the benefits of the invention can be effected at an overall cost which is less than for a coat having a face cloth made entirely of a spun NOMEX material.

Figure 5:
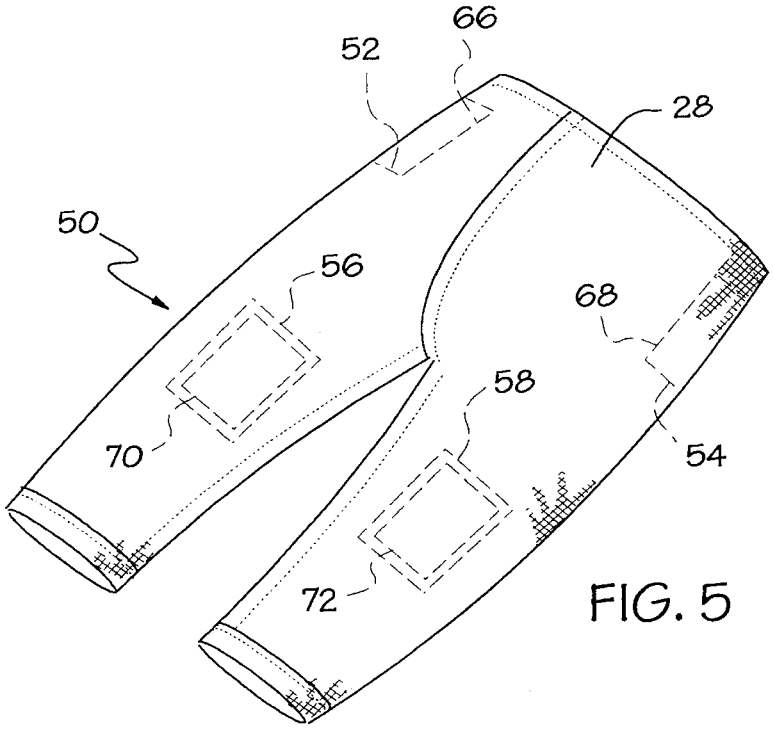
FIG. 5 is a somewhat schematic, perspective view of a firefighter pant embodying the invention.

As shown in FIG. 5, in an alternate embodiment of the invention, a firefighter pant 50, being made of the same lamination of materials as the coat 10''' shown in FIG. 4 includes hip and knee patches 52, 54, 56 and 58, respectively attached to the face cloth layer (not shown). Patches 52–58 are made of a spun NOMEX material which possesses high-lubricity and low friction characteristics, thereby reducing friction between the wearer and the garment at those areas of relatively high friction.

Similarly, as shown in FIGS. 4 and 5, patches 60, 62, 64, 66, 68, 70 and 72 may be applied to the outwardly-facing substrates 38''' of the moisture barrier layers 30''' of those garments (face cloth layer 30''' not shown in FIG. 5). Such patches reduce interlayer friction between the outer shells 28''' and the moisture barrier layers 30''' of those garments.

While the forms of the apparatus herein described constitute preferred embodiments of this invention , it is to be understood that the invention is not limited to these precise forms of apparatus, and that changes may be made therein without departing from the scope of the invention.

What is claimed is:

1. A firefighter garment comprising:

an outer shell;

a moisture barrier layer, positioned within said outer shell and made of a water-resistant material;

a high-lubricity layer of material adjacent to said moisture barrier layer, said high lubricity layer being made of a filament yarn.

2. The garment of claim 1 wherein said high-lubricity layer is bonded to and forms a substrate for said moisture barrier layer.

3. The garment of claim 1 further comprising a thermal barrier layer positioned within said outer shell.

4. The garment of claim 3 wherein said moisture barrier layer is positioned between said thermal barrier layer and said outer shell.

5. The garment of claim 4 wherein said high-lubricity layer is positioned between said moisture barrier and said outer shell.

6. The garment of claim 1 wherein said yarn is made of a fire-resistant material.

7. The garment of claim 1 further comprising an inner layer of face cloth material, positioned to interface with a wearer of said garment.

8. The garment of claim 7 wherein said inner layer is made of a high-lubricity material.

9. The garment of claim 8 wherein said high-lubricity material is a filament yarn made of a fire retardant material.

10. A firefighter garment having a body portion with a neck opening and sleeves extending from said body portion, comprising:

an outer shell;

a moisture barrier layer having a layer of semi-permeable membrane material and a substrate, bonded to and supporting said membrane material, made of a high lubricity, fire retardant filament material, said moisture barrier layer being positioned such that said substrate faces said outer shell;

a thermal barrier layer made of a fire retardant material and positioned within said moisture barrier layer such that said semi-permeable membrane material is positioned to face said thermal barrier layer; and a face cloth layer, made of a high-lubricity, fire retardant filament material, attached to said thermal barrier and positioned to face a wearer of said garment, whereby friction between said outer shell and said moisture barrier layer and between said thermal barrier layer and the wearer of said garment is minimized, thereby minimizing the stress said garment imposes upon the wearer thereof in resisting movement of the the wearer.

11. The garment of claim 10 wherein said substrate and said face cloth layer extend substantially throughout said body portion and said sleeves.

12. A firefighter garment having a body portion and a pair of sleeves extending from said body portion, comprising:

an outer shell layer of fire and abrasion resistant material;

a moisture barrier layer positioned within said outer shell;

a thermal barrier layer positioned within said outer shell adjacent to said moisture barrier layer; and means, positioned adjacent to at least one of said outer shell layer, moisture barrier layer and thermal barrier layer, having high-lubricity and forming a low friction interface between selected adjacent ones of said layers of said garment, said high-lubricity means including a layer of a filament yarn.

13. The garment of claim 12 wherein said high-lubricity means includes means forming a patch of high-lubricity material.

14. The garment of claim 13 wherein said patch means is positioned at areas of high movement of the wearer relative to the garment.

15. The garment of claim 14 wherein said areas include elbows and shoulder areas of said garment.

16. A firefighter garment having a body portion and a pair of sleeves extending from said body portion, comprising:

an outer shell layer of fire and abrasion resistant material;

a moisture barrier layer positioned within said outer shell;

a thermal barrier layer positioned within said outer shell adjacent to said moisture barrier layer; and a face cloth layer of a high lubricity, fire resistant material positioned within said thermal barrier layer, thereby forming a low friction interface between said thermal barrier layer and a wearer of said garment, said face cloth layer being quilted to said thermal barrier layer.

17. A firefighter garment comprising:

an outer shell;

a moisture barrier layer, positioned within said outer shell and made of a water-resistant material; and a layer of face cloth material made of a fire-resistant, filament yarn, whereby friction between said garment and a wearer thereof during donning and doffing of said garment and movement of said wearer while wearing said garment is reduced, thereby reducing heat stress sustained by said wearer while wearing said garment.

18. A firefighter garment comprising:

an outer shell;

a moisture barrier layer, positioned within said outer shell and made of a water-resistant material;

a high-lubricity layer of material adjacent to said moisture barrier layer;

an inner layer of face cloth material, positioned to interface with a wearer of said garment, said inner layer being made of a high-lubricity material, said material being a filament yarn made of a fire retardant material.

* * * * *